US006584734B2

(12) United States Patent
Mihalicz et al.

(10) Patent No.: US 6,584,734 B2
(45) Date of Patent: Jul. 1, 2003

(54) LOCKING GROUND HOLE COVER

(76) Inventors: Larry Mihalicz, 23 Watts Bay, Regina, Saskatchewan (CA), S4N 5G6; Orest Boyachek, 6132 Wellband Dr., Regina, Saskatchewan (CA), S4X 4A4

( * ) Notice: Subject to any disclaimer, the term of this patent is extended or adjusted under 35 U.S.C. 154(b) by 0 days.

(21) Appl. No.: 09/734,355

(22) Filed: Dec. 11, 2000

(65) Prior Publication Data

US 2001/0003886 A1 Jun. 21, 2001

(51) Int. Cl.[7] ..... E04F 19/08; E02D 29/14

(52) U.S. Cl. ..... 52/19; 52/20; 404/25

(58) Field of Search ..... 52/20, 19, 170, 52/19.21, 19.2, 21; 404/25, 26; 292/237, 238, 338, 53; 220/234, 235; 215/358, 360, 361

(56) References Cited

U.S. PATENT DOCUMENTS

| | | | | | |
|---|---|---|---|---|---|
| 822,562 | A | * | 6/1906 | Tucker | 404/25 |
| 845,182 | A | * | 2/1907 | Letts | 404/25 |
| 897,046 | A | * | 8/1908 | Armstrong | 404/25 |
| 1,287,290 | A | * | 12/1918 | Golden | 292/192 |
| 1,458,391 | A | * | 6/1923 | Burton | 292/237 |
| 1,610,123 | A | * | 12/1926 | Fairweather | 292/237 |
| 1,616,298 | A | * | 2/1927 | Arnett | 292/237 |
| 3,426,659 | A | * | 2/1969 | Clarke et al. | 94/35 |
| 3,921,494 | A | * | 11/1975 | Coe | 292/192 |
| 4,101,154 | A | * | 7/1978 | Kagstrom | 292/237 |
| 4,493,199 | A | * | 1/1985 | Uyeda | 70/1.5 |
| 4,690,597 | A | * | 9/1987 | Liebig | 411/32 |
| 4,964,755 | A | * | 10/1990 | Lewis et al. | 292/336.3 |
| 5,052,851 | A | * | 10/1991 | Frishauf | 404/25 |
| 5,253,952 | A | * | 10/1993 | Selway | 239/201 |
| 5,403,116 | A | * | 4/1995 | Brewer | 137/371 |
| 5,799,686 | A | * | 9/1998 | Tuomey | 137/375 |
| 5,951,200 | A | * | 9/1999 | Barton | 404/25 |
| 5,979,117 | A | * | 11/1999 | Fuller | 404/25 |
| 5,987,824 | A | * | 11/1999 | Fuller | 404/25 |
| 6,336,770 | B1 | * | 1/2002 | Evans | 138/173 |
| 6,488,440 | B1 | * | 12/2002 | Hill | 404/25 |

FOREIGN PATENT DOCUMENTS

| | | | |
|---|---|---|---|
| CH | 675138 A5 | * | 8/1990 |
| DE | 26 47 204 A1 | * | 5/1977 |
| DE | 36 03 825 A1 | * | 4/1987 |
| JP | 0047466 | * | 2/1990 |

* cited by examiner

*Primary Examiner*—Carl D. Friedman
*Assistant Examiner*—Kevin McDermott
(74) *Attorney, Agent, or Firm*—Stites & Harbison, PLLC; David W. Nagle, Jr.

(57) ABSTRACT

A locking ground hole cover is disclosed comprising a cover plate with a scissor-type apparatus suspended therefrom which apparatus can be actuated from above the cover plate. The apparatus allows for the locking of a hole by pulling the cover plate down into a sealed locked position with the hole mouth. Variations on the device are disclosed.

25 Claims, 5 Drawing Sheets

LOCKING GROUND HOLE COVER

This invention is in the field of covers for holes, and more particularly deals with a locking cover for temporary use in a ground hole such as a post hole or the like.

BACKGROUND

In many situations, such as construction sites or the like, excavations are undertaken which yield various vertical tubular holes in the ground. These might be drilled, augered or hydro-excavated.

The problem of safety presents itself with respect to these holes, when the construction site needs to be closed up for the day or the work crew needs to leave the hole unattended for some time and they wish to cover up the hole or close the hole for safety purposes. In some cases, the construction site might just be taped or fenced off or the hole covered with a piece of wood or the like, but these conventional methods have their limitations. Firstly, persons or vandals can uncover these holes and leave them open. The open hole is a hazard to anyone walking in the vicinity, as the can fall in the hole and injure a limb, or in the case of small children they might even fall into a larger hole. Safety regulations thus require the closure of these holes. A construction crew working on a series of holes, particularly in close vicinity to a school or the like, may find that they have to have extra people on staff to watch the holes or require some method of safely and conveniently locking those holes closed until they wish to return and complete the work and fill the hole back in.

Numerous attempts have been made in the art to provide covers for such holes. U.S. Pat. No. 5,979,117 to Fuller, "Hole Locking Device", is one such device. This device is limited in its utility, however, since the telescoping cylindrical sections of that device need to be selected to correspond to the internal diameters of different holes in which the device is to be used. As such, it is difficult to manufacture a single universal size of that device, and it will likely take more than one individual to manipulate such a device into position in a hole.

Another effort of interest is disclosed in U.S. Pat. No. 4,101,154 to Kagstrom for a "Locking Device for Well Covers and the Like". That disclosure relates to a device for locking the lid or cover in place on a well casing or the like. That device would be of only limited utility in anything but a pipe casing, since it is designed to operate within smooth pipe walls. The locking arms of that device would not properly handle an uneven hole wall. As well, that device has other limitations insofar as it allows for the limited raising of the cover from the top of the hole being covered. When actuating the Kagstrom device by placing it into a well, the device does not pull the lid down onto the hole. This limited degree of play could still allow for mischief or mishap.

There is a need for a secure and simple device to be used to lock and cover excavation holes, such as fence post holes, pile holes, hydro-excavation holes, and the like to prevent people, especially children, from falling in. Ideally, the apparatus used to lock the cover in place over the hole will also pull the cover down into the earth such that the hole is completely locked.

SUMMARY OF THE INVENTION

It is the object of the present invention to provide a portable locking ground hole cover for use on construction sites or the like which can be easily installed and removed by a minimum number of people, and which is easier and less costly to manufacture than those known in the art.

Further it is the object of the present invention to provide a locking ground hole cover that in addition to locking a cover plate over a hole by resting it in place on the ground surface over the hole, the action of locking the ground hole cover into position also exerts downward force on the cover adding to the strength of the lock.

The invention, a locking hole cover for use in a hole, the hole having an opening mouth and walls accomplishes these objects comprising substantially a cover plate having a lower surface and an upper surface; a plurality of wall-engaging tensioning arms, each the wall-engaging tensioning arm being hingably attached to the cover plate at a point below the lower surface, the unhinged end of each the tensioning arm, being a wall-engaging end, extending generally away from the cover plate; and a spreading apparatus engaging the tensioning arms such that when the spreading apparatus is moved towards the cover plate the wall-engaging ends of the tensioning arms will be forced outwards, and when the spreading apparatus is moved away from the cover plate the wall-engaging ends of the tensioning arms will be pulled inwards; and a shaft extending downwards from the lower surface of the cover plate and engaging the spreading apparatus such that the movement of the shaft will cause the movement of the spreading apparatus either towards or away from the cover plate.

Several methods of engagement could be used between the cover plate, the shaft and the spreading apparatus to ensure the proper movement of the tensioning arms. In one embodiment the shaft is slidably attached through the cover plate and the spreading apparatus is fixedly attached to the shaft, such that movement of the spreading apparatus towards or away from the cover plate is actuated by pulling or pushing the shaft from the upper surface of the cover plate.

In another embodiment the shaft is rotatably attached to the cover plate such that the shaft can be rotated from the upper surface of the cover plate, the shaft engaging the spreading apparatus such that rotation of the shaft will cause movement of the spreading apparatus either towards or away from the cover plate. Specifically, it is contemplated that the portion of the shaft engaged by the spreading apparatus throughout the range of its movement towards or away from the cover plate is threaded, and engages a corresponding threaded receptacle passing through the spreading apparatus.

The spreading apparatus might be a rigid member slidably engaging each tensioning arm. The rigid member could slidably engage each tensioning arm by way of an aperture at each end of the rigid member through which apertures the tensioning arms slidably pass. The rigid member might be perpendicular to the axis of the shaft.

Alternatively, the spreading apparatus could comprise a plurality of spreading arms hingably attached to each other at one end at which end the shaft will be engaged, and the free end of each the spreading arm is hingably attached to a midpoint of a corresponding tensioning arm. The spreading arms might be attached to reflective points on each the tensioning arm, defining a parallelogram, although that would not be necessary. Otherwise, the free end of each the spreading arm could also be hingably attached to a wall-engaging end of a corresponding tensioning arm.

The spreading apparatus and the tensioning arms could be locked in position by locking the shaft in position relative to the cover plate.

The tensioning arms could either be attached directly to the lower surface of the cover plate, or the cover plate might further include an arm extension extending downwards from the lower surface of the cover plate the tensioning arms are hingably attached.

Wall-engaging adapters could be attached at the wall-engaging ends of the tensioning arms, to increase the traction between the tensioning arms and the walls of the hole. Various types of wall-engaging adapters could be used depending upon the type of surface of the hole wall. For example, different adapters could be used for rock, hard soil, clay, sand or the like. These adapters could be rendered removable so that the versatility of the device is again improved and the apparatus can be easily adjusted for different soil conditions.

In order to make the device even more universal, extenders could be used in place of or as part of wall-engaging adapters. Extenders could be used to extend the reach of the tensioning arms away from the shaft so that the device could be used in wider holes.

In a situation where the cover plate is not large enough to cover the mouth of a larger hole, and to increase the versatility and universality of the device, the device might also include an adapter plate for placement between the mouth of the hole and the cover plate, the adapter plate being larger than the mouth of the hole and having an aperture extending therethrough, the aperture being smaller than the cover plate and large enough to allow the remainder of the hole cover attached to the cover plate to pass through the aperture.

Cover plates of various cross-sectional profiles could be used. In addition to a flat cover plate, it is particularly contemplated that a convex plate could be used. The outer edge of the convex cover plate could then bite into the soil surface around the hole when the cover plate was pulled down by the remainder of the apparatus as the tensioning arms grabbed the walls of the hole.

The shaft extends through the arm extension, where present. In such a case, the shaft and the arm extension could be hingably attached to the lower surface such that the cover plate has a limited range of movement in directions away from perpendicular to the remainder of the apparatus, while maintaining its attachment to the remainder of the apparatus.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

FIG. 3*a* is a side view of the embodiment of FIG. 3;

DETAILED DESCRIPTION OF THE ILLUSTRATED EMBODIMENTS

Several embodiments of the present invention will accomplish the goal of providing a locking ground hole cover which, in addition to simply locking a cover plate in position over a hole in the ground, will pull the cover plate down and exert downward force on the cover plate in the direction of the ground to further strengthen the closure or seal of the hole.

Figure 1:
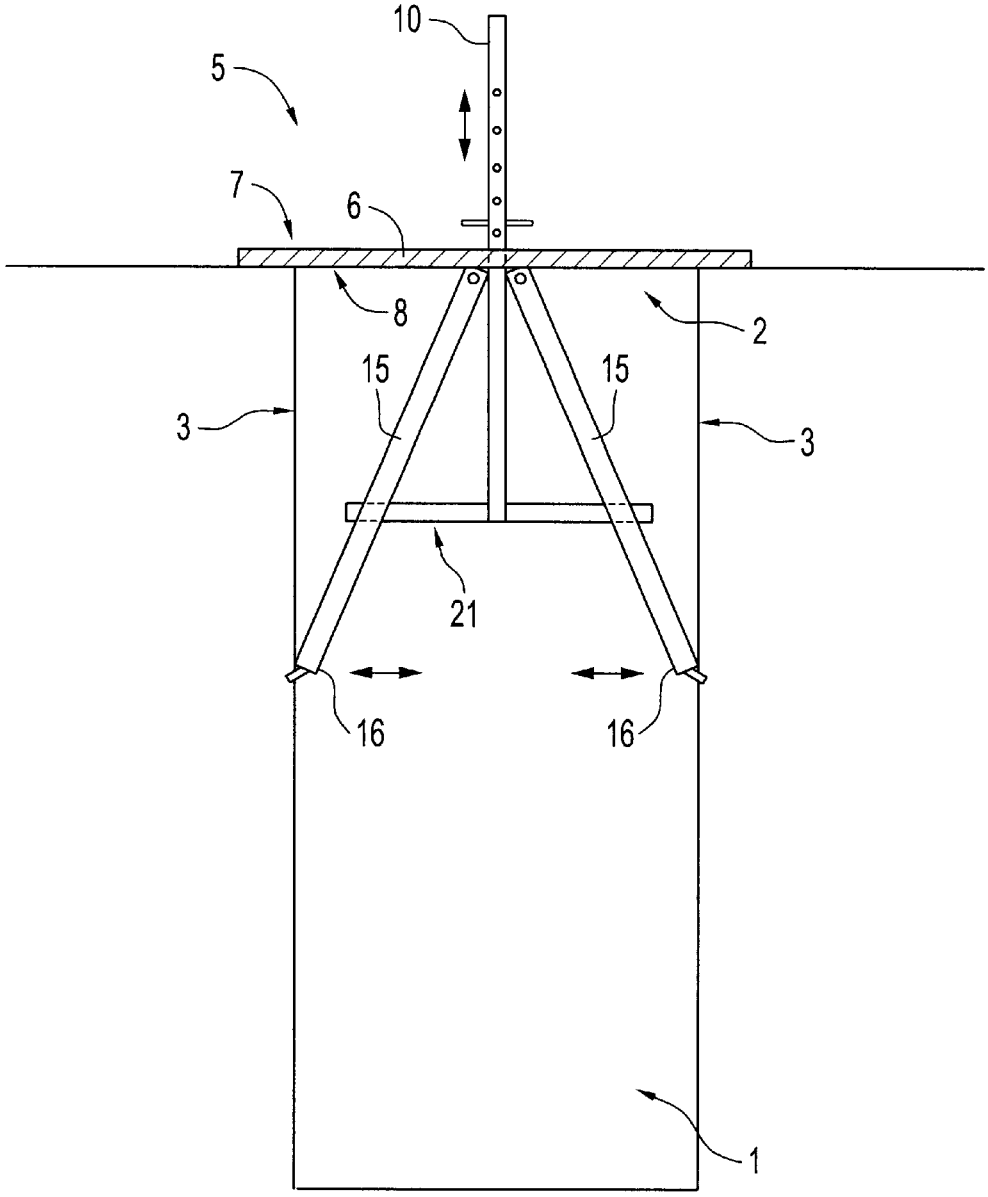
FIG. 1 is a side view of one embodiment of the present invention.

FIG. 1 shows a first embodiment of the invention. Firstly, a hole (1) is shown, the hole (1) having a mouth (2) and walls (3). Holes of various sizes, and to some extent of various shapes, can be accommodated by the apparatus of the present invention. It will be understood that insofar as the apparatus of the present invention can be used in holes of varying shapes as outlined herein or with any slight modifications, the use of such an apparatus with any type of hole is contemplated within the scope of the present invention.

The device itself as shown is a locking hole cover (5) for use in a hole (1), the locking hole cover (5) having several elements, including a cover plate (6). The cover plate (6) has an upper surface (7) and a lower surface (8). In this particular embodiment, the upper surface (7) of the cover plate (6) is flat. It will be understood that other cross-sectional profiles could be used for the cover plate (6). For example, in later embodiments it will be shown that a convex upper surface (7) of the cover plate (6) is particularly preferable. It will be understood that insofar as any cover plate being used accomplishes the goal of covering the hole (1) and allowing the apparatus to pull said cover plate (6) down towards the earth and said hole (1), any such cross-sectional profile is contemplated within the scope of the present invention.

In addition to the cover plate (6), there is shown a plurality of wall engaging tensioning arms (15). In this particular case, two tensioning arms (15) are shown. Each wall engaging tensioning arm (15) is hingably attached to the cover plate (6) at a point below the surface (7) of the cover plate (6). In this particular case, the tensioning arms (15) are attached directly to the lower surface (8) of the cover plate (6). Later embodiments will also show how the tensioning arms (15) can be mounted at a point vertically below the lower surface (8), using an arm extension. The unhinged end (16) of each tensioning arm (15) is a wall engaging end. The wall engaging end will be pressed outwards against the walls (3) of the hole (1) when the apparatus (5) is locked in position. Generally, however, it can be seen that the tensioning arm (15) and the wall engaging ends (16) thereof extend away from said cover plate (6).

The next element of the present invention demonstrated in FIG. 1 is the spreading apparatus. A spreading apparatus, in this case a rigid spreading member (21), engages each of the tensioning arms (15) such that when the spreading apparatus (21) is moved towards the cover plate (6), the wall engaging ends (16) of the tensioning arms (15) will be forced outwards, towards the walls (3) of the hole (1), and when said spreading apparatus (21) is moved away from the cover plate (6), the wall engaging ends (16) of the tensioning arms (15) will be pulled inwards away from the walls (3) of the hole (1).

While a rigid spreading member (21) is shown in this particular embodiment, it will be understood that other types of spreading apparatus accomplishing the same objective could be used. For example, others as are shown in subsequent embodiments of this detailed description. It will be understood that any such spreading apparatus accomplishing the same goal of moving the wall engaging ends (16) of the tensioning arms (15) towards the walls (3) of the hole (1) when locking the apparatus in position and releasing them when unlocking the apparatus, while at the same time in the locked position exerting downward force on the cover plate (6), are all contemplated within the scope of the present invention.

The final element of the present invention demonstrated in FIG. 1 is a shaft (10) which extends downwards from the lower surface (8) of the cover plate (6) and engages the spreading apparatus (21) such that movement of the shaft (10) will cause the movement of the spreading apparatus (21) either towards or away from the cover plate (6). It will be understood that the shaft (10) or its equivalent is used to actuate the locking of the device (5) from above the upper surface (7) of the cover plate (6), while the apparatus (5) is in place in a hole (1).

In this particular case, the shaft (10) is slidably attached through the cover plate (6) and emerges above the upper surface (7) of the cover plate (6), while the spreading member (21) is fixedly attached to the shaft (10) at or near its down-hole end (12). Each of the tensioning arms (15) extends through an aperture or collar defined at the ends of the spreading member (21). In order to lock the cover apparatus (5) of the present invention in place in a hole (1), the shaft (10) is pulled upwards out of the upper surface (7) of the cover plate (6). As can be seen from the diagram, pulling the shaft (10) upwards will result in the upwards movement of the spreading member (21), which in turn will force the tensioning arms (15) and their wall engaging ends (16) out and towards the hole walls (3). In order to unlock the apparatus (5) of the present invention, the shaft (10) will be released and pressed back down into the hole (1) through the cover plate (6) from outside the hole (1), via the upper surface (7) of the cover plate (6). As can be seen again, pressing the shaft (10) downwards in such an action will result in the downwards movement of the spreading member (21) and an attendant collapsing motion on the tensioning arms (15), disengaging the wall engaging ends (16) of the tensioning arms (15) from the walls (3) and allowing for the removal of the apparatus (5) from the hole (1).

In this particular figure, the apparatus (5) is shown in its locked position, with the shaft (10) raised and the tensioning arms (15) forced out against the walls (3) of the hole (1). The apparatus would be unlocked by releasing the shaft (10) to move downwards within the hole (1), at which point the spreading member (21) would pull in the tensioning arms (15) away from the walls (3) of the hole (1).

Also shown in FIG. 1 are wall engaging adaptors (18) attached at the wall engaging ends (16) of the tensioning arms (15). The wall engaging adaptors (18) might be interchangeable, since different types of adaptors might work better in situations where the walls of the hole are of different consistency or material. For example, one or more spikes might be used as the wall engaging adaptor (18) where the wall of the hole was hard soil or clay, whereas if the hole was sandy or soft, a cup or some other type of attachment might be used which would better engage the hole wall. In a situation where the hole was smooth on the inside, a rubber grip of some type might be used. It will be understood that in any case, the use of any type of a wall engaging adaptor on the tensioning arms (15), which adaptor has the purpose and effect of increasing the grip between the wall engaging ends (16) and the wall of the hole (3) is contemplated within the scope of the present invention.

In operation of the apparatus (5), since the tensioning arms (15) are actuated from below, the tensioning arms (15) also exert a downward force on the cover plate (6) as the wall engaging ends (16) are driven into the walls (3) of the hole (1). This is another of the main advantages of the apparatus of the present invention, since in addition to simply locking the cover plate (6) over the hole (1) in whatever position it is set by the operator, the apparatus (5) will actually pull the cover plate (6) into a properly locked position.

It is possible to lock the cover plate (6) and the tensioning arms (15) in their position within the hole (1) by locking the shaft (10) in position in relation to the cover plate (6). In this particular situation, the method of locking which is used is a series of shaft locking holes (13) within the shaft (10), through which a locking pin (14), padlock or the like could be placed once the shaft (10) had been ratcheted upwards to the point that the cover was satisfactorily locked in position within the hole (1). It will be understood that any other method of locking the position of the shaft (10) in relation to the cover plate (6), from outside of the hole (1), is contemplated within the scope of the present invention as well.

Figure 2:
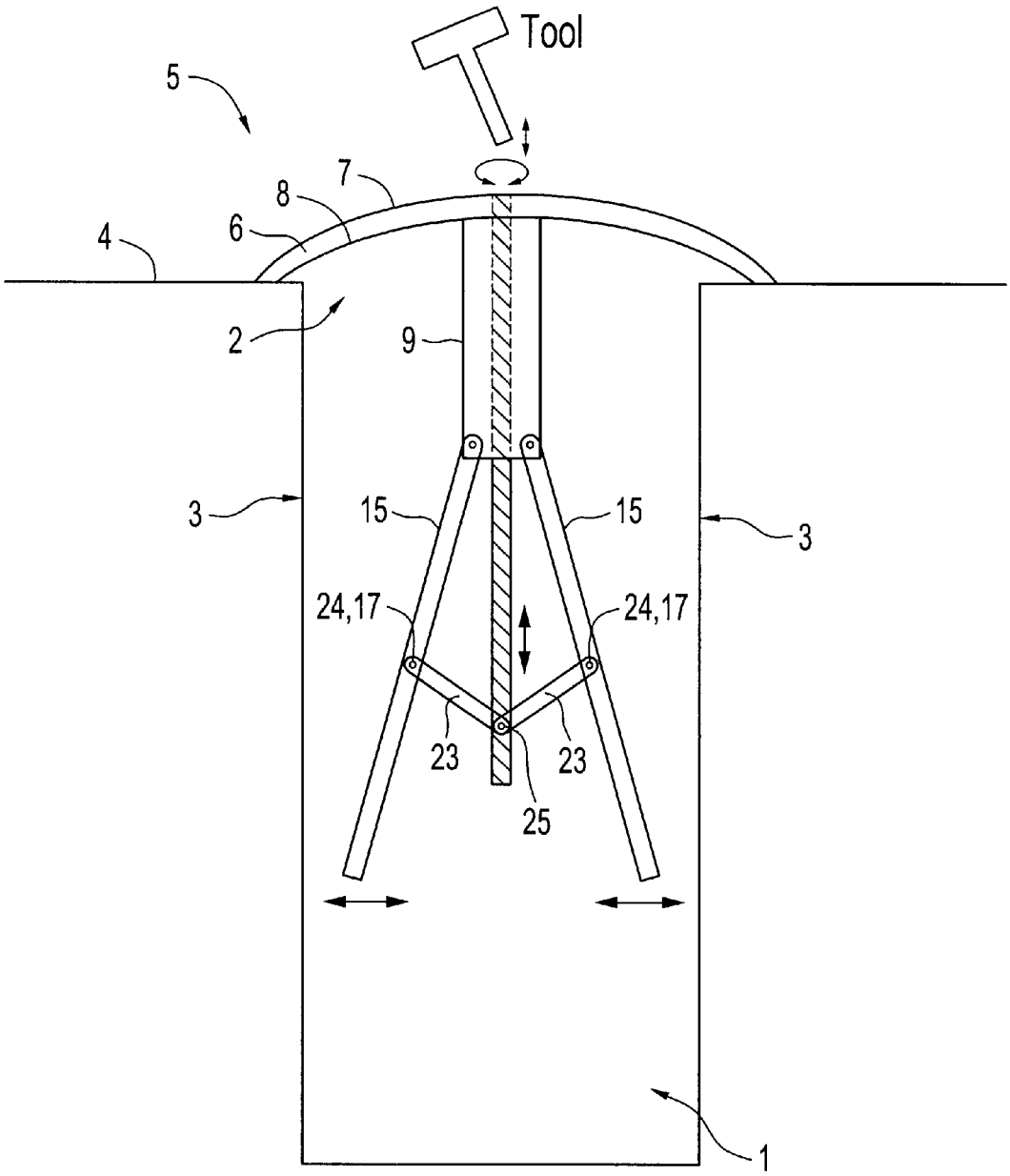
FIG. 2 is a side view of another embodiment of the present invention, wherein the cover plate is convex.

FIG. 2 demonstrates a side view of another embodiment of the present invention. Again, the hole (1) is shown with its mouth (2) and walls (3). The ground surface (4) around the hole mouth (2) can also be seen.

The basic concept of the apparatus (5) of this embodiment is the same as that of FIG. 1. There is shown the cover plate (6), which in this case has a convex side profile.

In this particular case, with the cover plate (6) of a convex cross-section, the downward pressure exerted on the cover plate (6) by the remainder of the apparatus (5) when the tensioning arms (15) are forced into the walls (3) of the hole (1), will also pull the cover plate (6) in effect down into the ground surface (4) around the mouth (2) of the hole (1). The outer edge of the convex cover plate (6) will allow for this biting action into the soil or onto the surface (4).

The apparatus of FIG. 2 displays several other variations which can be made on the invention as well. Firstly, the wall engaging tensioning arms (15) are actually attached to the cover plate (6) at a point below the lower surface (8) of the cover plate (6) by way of an arm extension (9). The arm extension (9) extends downwards from the lower surface (8) of the cover plate (6) and the arm extension (9) is then the portion of the cover plate (6) to which the tensioning arms (15) are hingably attached and from which they extend generally downwards into the hole (1) away from the cover plate (6). It will be understood that arm extensions of various types and lengths could be used so long as they accomplish the objective of placing the attachment point of the tensioning arms (15) a distance down into the hole (1) away from the lower surface (8) of the cover plate (6). Any type of a configuration of the arm extension (9) accomplishing this objective is contemplated within the scope of the present invention.

The tensioning arms (15) can be seen in this figure as well.

In this case, the spreading apparatus consists of a plurality of spreading arms (23). The spreading arms (23) are hingably attached to each other at one end (25), at which end the shaft (10) will also be engaged. The free end (24) of each spreading arm (23) is hingably attached to a tensioning arm (15). Since in this particular embodiment the number of tensioning arms (15) again is two, the number spreading arms (23) is also two. It will be understood that the number of tensioning arms (15) and spreading arms (23) could be varied in co-ordinating pairs and any such change in the number of tensioning arms (15) or spreading arms (23) are contemplated within the scope of the present invention as well.

In this particular embodiment, the attachment ends (24) of the spreading arms (23) are attached to reflective midpoints (17) of each tensioning arm (15). It will be understood that the spreading arms (23) could engage the tensioning arms (15) at any point along their length, so long as the hingable attachment was such that the proper raising and lowering action of the spreading apparatus (23) still accomplished the goal of forcing the tensioning arms (15) outwards from the shaft (10) or pulling them inwards to collapse the apparatus.

While in this case the spreading arms (23) are attached at reflective points, ie. at points the same distance along each of the tensioning arms (15), it will be understood that in certain circumstances this may not be the case and insofar as the apparatus is still functional in the same manner these changes as well are contemplated within the scope of the present invention.

The operation of the shaft (10) is different in this embodiment as well.

Rather than having the fixedly attached spreading member of FIG. 1, the spreading apparatus (23) is operated differently in this embodiment—the shaft (10) is rotatably attached to the cover plate (6) such that the shaft (10) can be rotated from the upper surface (7) of the cover plate (6). As can be seen in this particular case, the shaft (10) is rotatably attached to the cover plate (6) perpendicular to the lower surface (8) of the cover plate (6). The engagement of the spreading apparatus (23) and the shaft (10) can then be such that rotary action of the shaft (10) causes the movement of the spreading apparatus (23) up and down along the shaft (10).

In this particular case, the portion of the shaft (10) engaged by the spreading apparatus (23) throughout the range of its movement towards or away from the cover plate (6) is threaded. The threaded portion of the shaft (10) engages a corresponding threaded receptacle passing through the spreading apparatus, which in this case is the attached plurality of spreading arms (23). Rotation of the shaft (10) would then result in the movement of the spreading apparatus (23) up and down along a length of the shaft (10), which in turn would exert outward or inward pressure on the tensioning arms (15). In this particular case, the shaft (10) is attached through the cover plate (6) such that it can be rotated using a keyed wrench or other tool and the shaft (10) would not protrude to any significant degree above the upper surface (7) of the cover plate (6). This flush nature of the top end of the shaft (10) in relation to the cover plate (6) would further increase the safety provided by the apparatus (5) of the present invention.

It will be understood that this threaded embodiment is simply another method of demonstrating how the shaft (10) might be used to actuate the spreading apparatus (23) and any other such method of attachment in co-operation between the cover plate (6), shaft (10) and spreading apparatus (23) accomplishing the same goal is contemplated within the scope of the present invention.

It will be understood that whilst this particular embodiment demonstrates the preferred method of attachment of the shaft and the cover plate insofar as it leaves a relatively flush upper surface of the cover plate without a protruding section of the shaft, another alternative embodiment would be to thread the entire shaft and have the shaft pass through a threaded receptacle on the cover plate, and then fixedly attach the spreading apparatus to the lower portion of the shaft, whereby rotation of the shaft would result in the pulling up or pushing down of the shaft, similar to the embodiment of FIG. 1.

Figure 3:
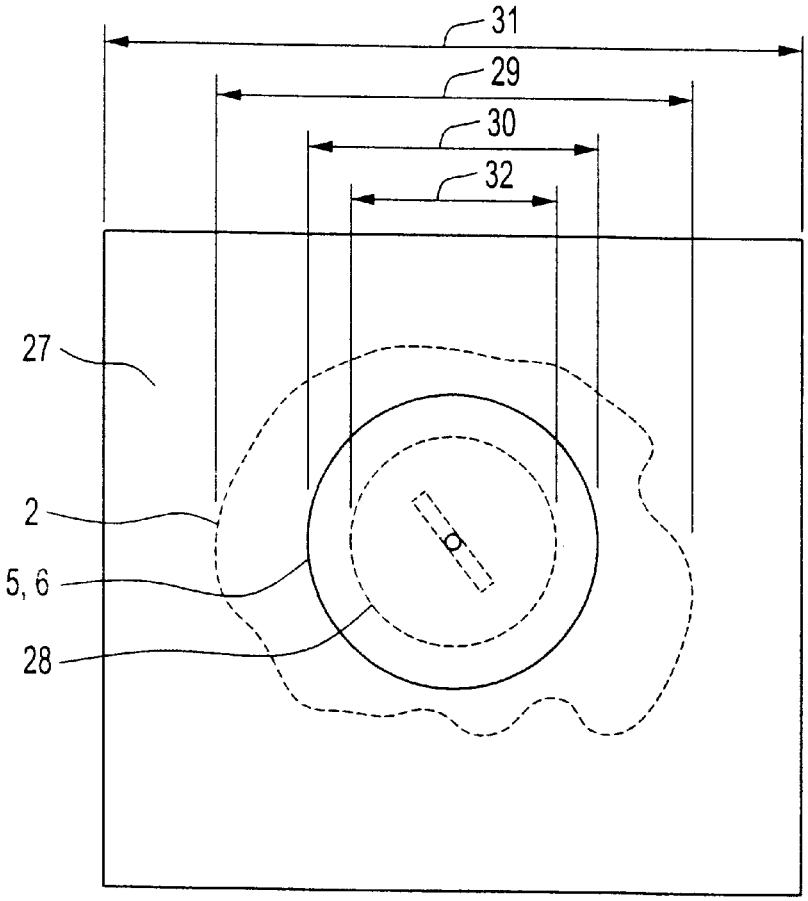
FIGS. 3 and 3*a* are respective top and side views of an embodiment of the apparatus of the present invention roughly according to FIG. 2.
Figure 3A:
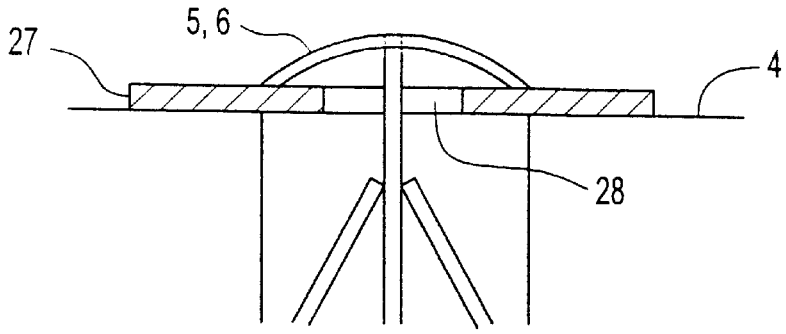

FIG. 3 is a top view of an embodiment of the apparatus of the present invention roughly according to FIG. 2. However, an adaptor plate (27) has been added to show the versatility and utility of the basic apparatus (5) of the present invention in a larger hole, wherein the width of the mouth of the hole shown as (29) is wider than the dimension or width of the cover plate (30). An adaptor plate (27) can be used which is wide enough, the width thereof shown as (31), to cover the entire mouth (2) of the hole (1). The adaptor plate (27) is placed on the ground surface (4) between the mouth (2) of the hole (1) and the cover plate (6), the adaptor plate (27) having an aperture (28) extending therethrough, the width (32) of the aperture being smaller than the width (30) of the cover plate (6) and large enough to allow the remainder of the apparatus (5) attached to the cover plate (6) to pass through the aperture. As such, the apparatus (5) can be dropped into position in the hole (1) through the aperture (28) of the adaptor plate (27) and the cover plate (6) will then engage the adaptor plate (27) which, in turn, engages the ground surface (4) around the mouth (2) of the hole (1). The tensioning arms (15) of the apparatus of the present invention could then still be levered into position against the interior walls (3) of the hole (1) either on their own or, as discussed below, extenders could be added to the ground engaging ends (16) of the tensioning arms (15).

Where, as in FIG. 2, the shaft (10) is attached such that it can be moved without protruding above the upper surface (7) of the cover plate (6), a removable wrench or other tool might be used to temporarily attach to the shaft (10) and rotate it. Another safety feature of the invention could be to provide for a keyed wrench or the like, such that it would make it even more difficult for an unauthorized person to unlock the device.

It will be understood that any type of an adaptor plate accomplishing the objects of the present invention, namely to provide a surface for the cover plate (6) to engage, which surface in turn is engaging the ground surface (4) around the mouth (2) of the hole (1), is contemplated within the scope of the present invention.

Figure 4:
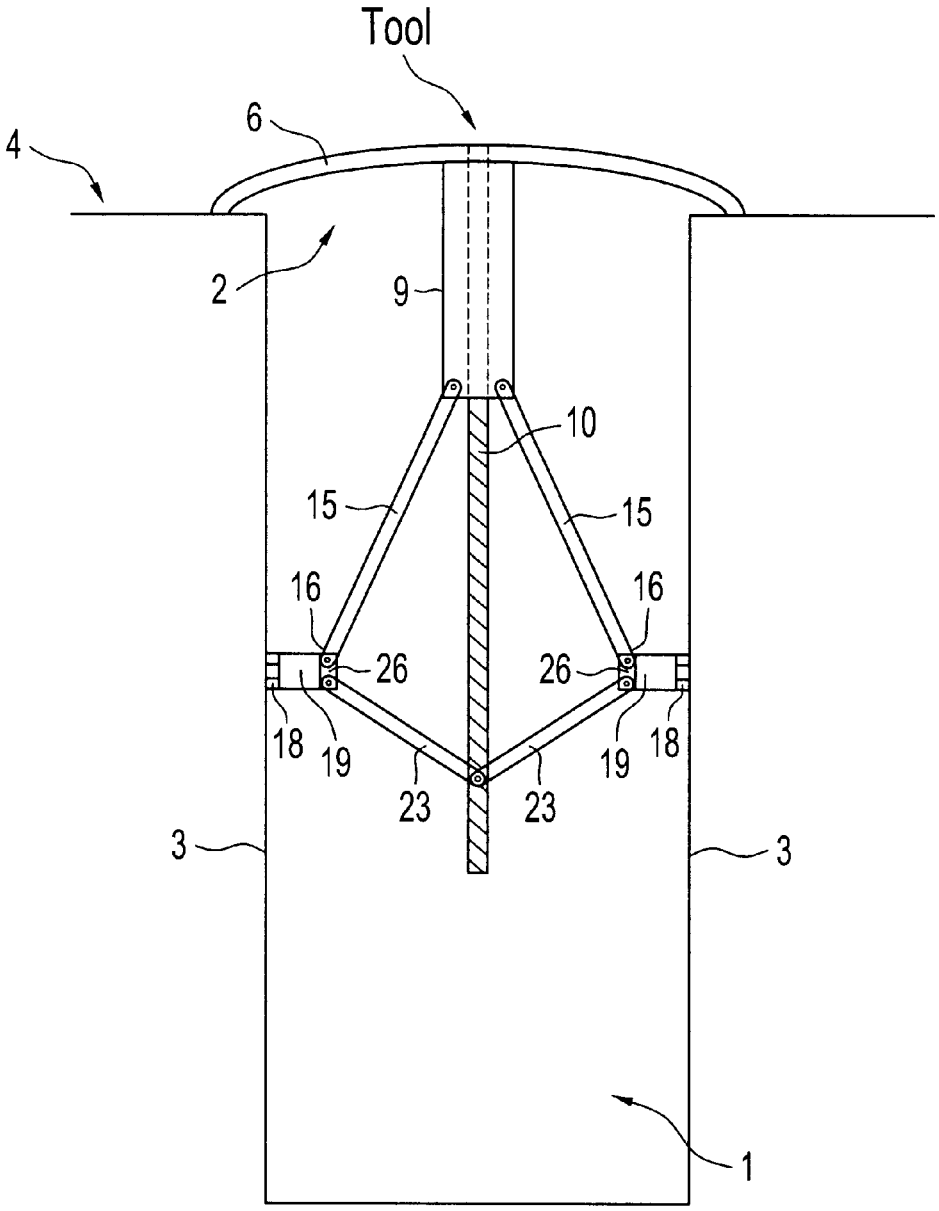
FIG. 4 is a side view of another embodiment of the present invention.

FIG. 4 shows another embodiment of the present invention with a different configuration of the tensioning arms (15) and the spreading apparatus (23).

Again, a convex cover plate (6) is shown, and the arm extension (9) and shaft (10) are configured the same as those in the embodiment shown in FIG. 2. The major difference between the embodiment of FIG. 4 and FIG. 2 is that of the spreading apparatus of this embodiment.

While the embodiment of FIG. 2 is shown in a loose or released fashion within the hole, the embodiment of FIG. 4 is again shown in its locked position with the tensioning arms (15) and their wall engaging ends (16) fully extended against the walls (3) of the hole (1).

In this particular case, while the same configuration of spreading arms (23) is used as in FIG. 2, the spreading arms (23) are attached to the tensioning arms (15) in a different fashion. Firstly, rather than being attached to any midpoint of the tensioning arms (15), the spreading arms (23) are hingably attached at the wall engaging ends (16) of the tensioning arms (15). In this particular case, a small hinge plate or attachment plate (26) has been used. Although it will be understood that with the proper necessary modifications, the spreading arms (23) and the tensioning arms (15) could be directly attached or other methods of attachment could be used, without departing from the scope and intent of the claimed invention.

Shown attached to the wall engaging ends (16) of the tensioning arms (15) are extenders (19). Extenders (19)

could optionally be added at the wall engaging ends (16) of the tensioning arms (15) to extend the reach of the tensioning arms (15) away from the shaft (10) for use in a larger hole. It will be understood, however, that the use of such extenders (19) is optional and as such the apparatus of the present invention both with or without said extenders (19) is contemplated within the scope of the claimed invention.

Also shown attached at the extreme ends of the extenders (19) are wall engaging adaptors (18) which again, in this particular embodiment, are of a spiked configuration.

The embodiment of FIG. 4 would be operated in the same fashion as that of FIG. 2, namely rotational power would be applied at the top of the shaft (10) from the upper surface (7) of the cover plate (6) and the rotation of said shaft (10) would cause the movement of the spreading apparatus (23) up and down along a section of the shaft (10) which would in turn cause the outward or inward movement of the tensioning arms (15) and any extenders (19) or wall engaging adaptors (18) disposed at the ends thereof.

Figure 5:
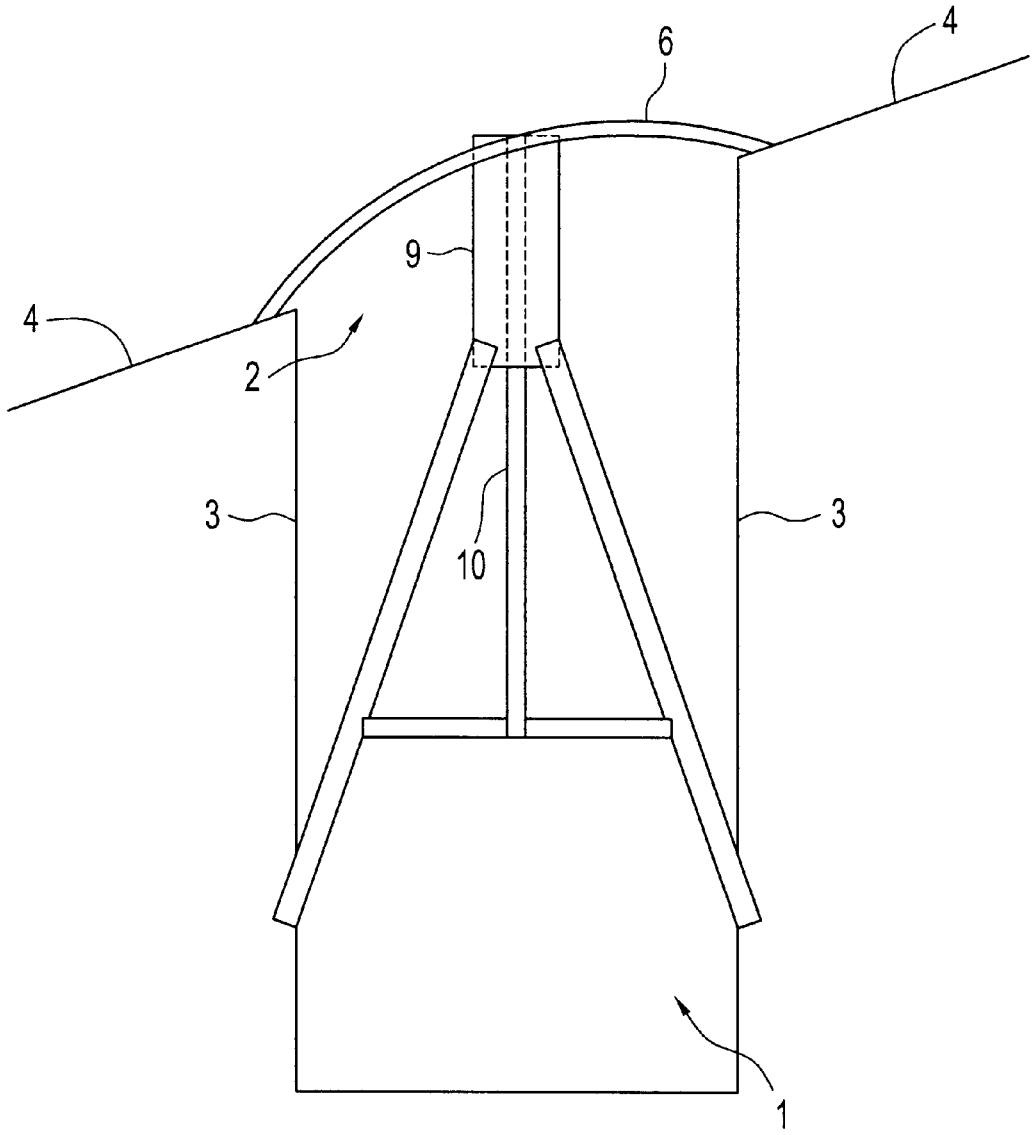
FIG. 5 shows another alternative embodiment of the present invention, for use on a sloped ground surface.

FIG. 5 demonstrates yet another alternative embodiment of the apparatus of the present invention, which would lend itself to use in a hole excavated in a sloping ground surface. Shown in that diagram is a hole (1), with a mouth (2) and walls (3). The ground surface (4) in which the hole (1) has been drilled is sloped. This ground surface (4) might be a hillside or the like. In order to make the apparatus of the present invention extend fully down into the hole (1) and yet have the cover plate (6) accommodate the sloping ground surface (4), the shaft (10) and any arm extension, shown in this diagram at (9), could be hingably attached in any number of methods, such as a ball joint, hinge or the like, to the cover plate (6) such that the shaft (10), tensioning arms (15) and spreading apparatus (23) could extend directly down the hole (1) and the cover plate (6) has a limited range of movement in directions away from perpendicular to the remainder of the apparatus while maintaining its attachment to the remainder of the apparatus, such that the tensioning arms (15) will pull the cover plate (6) down into sloped conformity and lock with the sloped ground surface (4) when the tensioning arms (15) are forced outwards into the hole walls (3). It will be understood that many different methods of hinging the attachment of the shaft and any arm extension could be used insofar as they all accomplish the same goal of allowing for a degree of play in the cover plate (6) in its attachment to the remainder of the apparatus, these different methods will all be contemplated within the scope of the present invention.

Shown in FIGS. 2, 4 and 5, the shaft (10) extends downwards through the arm extension (9) which arm extension (9) in these embodiments might comprise a collar or sleeve. It will be understood that other types of arm extensions (9) could also be used through which the shaft (10) would not necessarily have to extend, without departing from the scope of the present invention.

Thus it can be seen that the invention accomplishes all of its stated objectives. The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

We claim:

1. A locking hole cover for use in a hole, said hole having an opening mouth and walls, said cover comprising:

a) a cover plate having a lower surface and an upper surface;

b) a plurality of wall-engaging tensioning arms, each said wall-engaging tensioning arm being hingably attached to said cover plate, the unhinged end of each said tensioning arm, being a wall-engaging end, extending downwardly and away from a center of said cover plate; and c) a spreading apparatus engaging said tensioning arms such that when said spreading apparatus is moved towards said cover plate the wall-engaging ends of said tensioning arms will be forced outwards, and when said spreading apparatus is moved away from said cover plate said wall-engaging ends of said tensioning arms will be pulled inwards; and d) a shaft extending downwards from said lower surface of said cover plate and engaging said spreading apparatus such that the movement of the shaft will cause the movement of the spreading apparatus either towards or away from said cover plate.

2. The hole cover of claim 1 wherein said tensioning arms are hingably attached to the lower surface of said cover plate.

3. The hole cover of claim 1 wherein said hole cover further comprises an adapter plate for placement between the mouth of the hole and the cover plate, said adapter plate being larger than the mouth of the hole and having an aperture extending therethrough, said aperture being smaller than the cover plate and large enough to allow the remainder of the hole cover attached to said cover plate to pass through said aperture.

4. The hole cover of claim 1 further comprising wall-engaging adapters at the wall-engaging ends of each of said tensioning arms.

5. The hole cover of claim 4 wherein said wall-engaging adapters include extensions, whereby the reach of said tensioning arms away from said shaft is extended.

6. The hole cover of claim 1 wherein said upper surface of said cover plate is flat.

7. The hole cover of claim 1 wherein said upper surface of said cover plate is convex.

8. The hole cover of claim 1 wherein said shaft is slidably attached through said cover plate and said spreading apparatus is fixedly attached to said shaft, such that movement of said spreading apparatus towards or away from said cover plate is actuated by pulling or pushing said shaft from the upper surface of said cover plate.

9. The hole cover of claim 1 wherein said shaft is rotatably attached to said cover plate such that said shaft can be rotated from said upper surface of said cover plate, said shaft engaging said spreading apparatus such that rotation of said shaft will cause movement of said spreading apparatus either towards or away from said cover plate.

10. The hole cover of claim 9 wherein the portion of said shaft engaged by said spreading apparatus throughout the range of its movement towards or away from said cover plate is threaded, and engages a corresponding threaded receptacle passing through said spreading apparatus.

11. The hole cover of claim 8 wherein said spreading apparatus is a rigid member, slidably engaging each said tensioning arm.

12. The hole cover of claim 11 wherein said rigid member is perpendicular to the axis of said shaft.

13. The hole cover of claim 11 wherein said rigid member slidably engages each tensioning arm by way of an aperture at each end of said rigid member through which apertures said tensioning arms slidably pass.

14. The hole cover of claim 9 wherein said spreading apparatus is a rigid member, slidably engaging each said tensioning arm.

15. The hole cover of claim 14 wherein said rigid member is perpendicular to the axis of said shaft.

16. The hole cover of claim 14 wherein said rigid member slidably engages each tensioning arm by way of an aperture at each end of said rigid member through which apertures said tensioning arms slidably pass.

17. The hole cover of claim 8 wherein said spreading apparatus comprises a plurality of spreading arms hingably attached to each other at one end at which end said shaft will be engaged, and the free end of each said spreading arm is hingably attached to a midpoint of a corresponding tensioning arm.

18. The hole cover of claim 17 wherein said spreading arms are attached to reflective points on each said tensioning arm, defining a parallelogram.

19. The hole cover of claim 9 wherein said spreading apparatus comprises a plurality of spreading arms hingably attached to each other at one end at which end said shaft will be engaged, and the free end of each said spreading arm is hingably attached to a midpoint of a corresponding tensioning arm.

20. The hole cover of claim 19 wherein said spreading arms are attached to reflective points on each said tensioning arm, defining a parallelogram.

21. The hole cover of claim 8 wherein said spreading apparatus comprises a plurality of spreading arms hingably attached to each other at one end at which end said shaft will be engaged, and the free end of each said spreading arm is hingably attached to a wall-engaging end of a corresponding tensioning arm.

22. The hole cover of claim 9 wherein said spreading apparatus comprises a plurality of spreading arms hingably attached to each other at one end at which end said shaft will be engaged, and the free end of each said spreading arm is hingably attached to a wall-engaging end of a corresponding tensioning arm.

23. The hole cover of claim 1 wherein said spreading apparatus and said tensioning arms can be locked in position by locking said shaft in position relative to said cover plate.

24. The hole cover of claim 1 wherein said cover plate further comprises an arm extension extending downwards from the lower surface of said cover plate, and to which arm extension said tensioning arms are hingably attached.

25. The hole cover of claim 24 wherein said shaft extends through said arm extension.

* * * * *